US007855516B2

(12) United States Patent
Tsinker et al.

(10) Patent No.: US 7,855,516 B2
(45) Date of Patent: Dec. 21, 2010

(54) CONTROLLABLE POWER SUPPLY CIRCUIT FOR AN ILLUMINATION SYSTEM AND METHODS OF OPERATION THEREOF

(75) Inventors: Victor Tsinker, Jerusalem (IL); Alexander Firtel, Ashdod (IL)

(73) Assignee: Lighttech Electronic Industries Ltd., Lod (IL)

( * ) Notice: Subject to any disclaimer, the term of this patent is extended or adjusted under 35 U.S.C. 154(b) by 889 days.

(21) Appl. No.: 11/660,433

(22) PCT Filed: Aug. 1, 2005

(86) PCT No.: PCT/IL2005/000816

§ 371 (c)(1),
(2), (4) Date: Feb. 16, 2007

(87) PCT Pub. No.: WO2006/018830

PCT Pub. Date: Feb. 23, 2006

(65) Prior Publication Data

US 2007/0285028 A1 Dec. 13, 2007

(30) Foreign Application Priority Data

Aug. 16, 2004 (IL) ..... 163558

(51) Int. Cl.
*H05B 37/00* (2006.01)

(52) U.S. Cl. ..... 315/224; 315/307; 315/DIG. 4

(58) Field of Classification Search ..... 315/DIG. 4, 315/291, 307, 308, 219, 194, 198, 199
See application file for complete search history.

(56) References Cited

U.S. PATENT DOCUMENTS

| | | | | |
|---|---|---|---|---|
| 4,528,494 | A | 7/1985 | Bloomer et al. | |
| 5,600,233 | A | 2/1997 | Warren et al. | |
| 5,740,021 | A | 4/1998 | Lecheler et al. | |
| 6,034,790 | A | 3/2000 | Kamei et al. | |
| 6,097,158 | A | 8/2000 | Manor et al. | |
| 6,246,182 | B1 | 6/2001 | Yamasaki et al. | |
| 7,443,107 | B2 * | 10/2008 | Shannon et al. | 315/224 |
| 2002/0071299 | A1 | 6/2002 | Franck et al. | |
| 2003/0127994 | A1 | 7/2003 | Patchornik et al. | |
| 2003/0168996 | A1 | 9/2003 | Brevetti et al. | |

FOREIGN PATENT DOCUMENTS

| | | | |
|---|---|---|---|
| EP | 1 220 579 | A | 7/2002 |
| WO | WO 03/058801 | A1 | 7/2003 |

* cited by examiner

*Primary Examiner*—David Hung Vu
(74) *Attorney, Agent, or Firm*—Browdy and Neimark, PLLC

(57) ABSTRACT

A method for reducing acoustic noise produced during use of a lamp dimmer detects whether the dimmer is a leading edge (101) or a trailing edge dimmer (102). A nominal firing time of a leading edge dimmer is determined and a post-correction applied to a voltage applied to the dimmer starting from the nominal firing time so as to build-up the voltage gradually during a predetermined post-correction time period and thereby reduce the rate of rise of the leading edge thereof. A nominal cutoff time of a trailing edge dimmer is determined and a pre-correction applied to a voltage applied to the dimmer starting from the nominal cut-off time so as to diminish the voltage gradually during a predetermined pre-correction time period and thereby reduce the rate of rise of the leading edge thereof. Other methods are disclosed for soft starting filament lamps and controlling dimmer circuits.

7 Claims, 11 Drawing Sheets

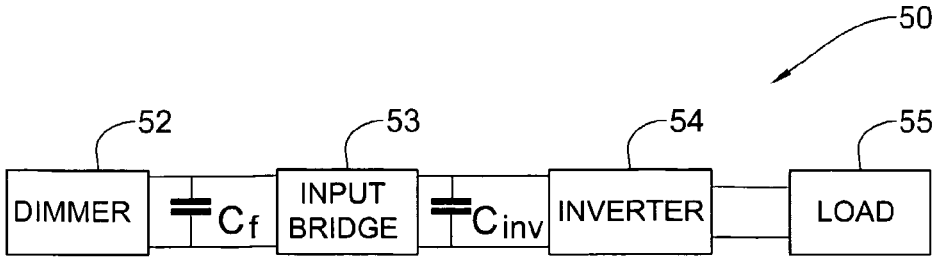
FIG. 6B
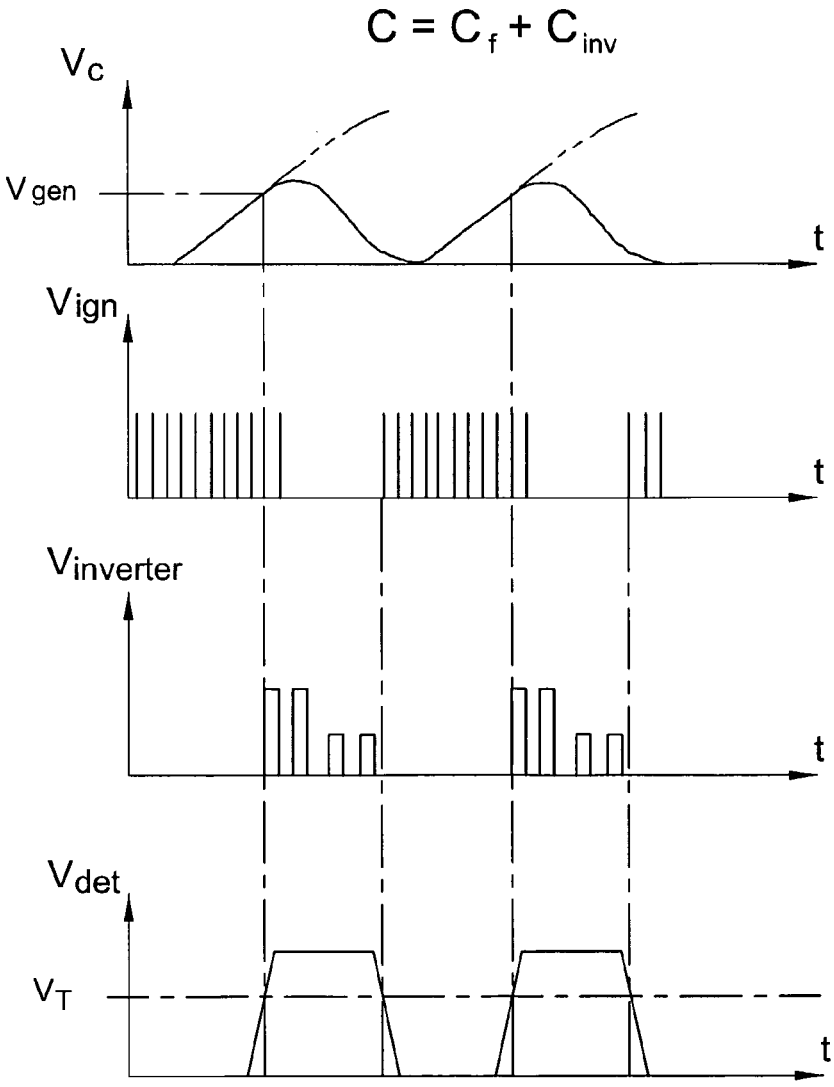
FIG. 7A
FIG. 7B
FIG. 7C
FIG. 7D energy storage concept precorrection concept $$t_{i-1} = \sum_{j=1}^{i-1} \Delta t_j$$

$$t_i = t_{i-1} + \Delta t_i$$

$$\Delta t_i = \frac{T}{N(i)}$$

$$I_i > Thr_{(i)} \Rightarrow \begin{cases} \Delta t_{i+1} = 0 & N_{(i+1)} = N_{max} \\ \Delta t_{i+1min} = \dfrac{T}{N_{max}} \end{cases}$$

$$I_i > Thr_{(i)} \Rightarrow \quad \Delta t_{i+1} < 0 \quad N_{(i+1)} = -N_{(i+1)}$$

CONTROLLABLE POWER SUPPLY CIRCUIT FOR AN ILLUMINATION SYSTEM AND METHODS OF OPERATION THEREOF

FIELD OF THE INVENTION

This invention relates to power supplies for low voltage lighting systems.

BACKGROUND OF THE INVENTION

Power supplies for lighting systems typically comprise a rectifier inverter system for converting an incoming mains voltage to a high frequency.

FIG. 1 shows a low voltage illumination system designated generally as 10 as described in U.S. Pat. No. 6,097,158 (Manor et al.) commonly assigned to the present assignee and incorporated herein by reference. The illumination system 10 comprises a pair of input terminals 11 and 12 for connecting to a source of low frequency AC voltage 13 shown in dotted outline. The AC voltage source 13 is derived from a conventional electricity supply feeder having a typical mains voltage of 347-100 V and a supply frequency of 50/60 Hz. A conventional rectifier 14 is coupled via the terminals 11 and 12 to the source of AC voltage 13 for converting the low frequency AC voltage to DC which is then fed to an inverter 15 containing a conventional chopper circuit for converting to high frequency AC at 30 KHz. The rectifier 14 in combination with the inverter 15 thus constitutes a frequency conversion means 16 for converting the low frequency AC voltage to high frequency AC voltage.

A step down transformer 17 is coupled to an output of the frequency conversion means 16 for converting the high frequency supply voltage of 347-100 V to high frequency, low voltage AC signal having low voltage 48 V or below, typically 12 V. The step down transformer 17 is preferably implemented using a toroidal ferrite core and the output winding is preferably implemented using a litz (bundle of very fine insulated wires) in order to minimize losses by reducing the leakage current due to the air gap between the primary and secondary windings and by reducing losses due to the skin-effect and proximity effect. Other cores and windings can also be used. Alternatively a higher frequency may be generated and the output transformer implemented using a planar transformer.

In this prior art, albeit not in conventional prior art, to prevent the drawback associated with large high frequency currents, the high frequency signal is rectified using a synchronous rectifier 18 coupled to a secondary winding (not shown) of the step down transformer 17 for converting the low voltage AC to low voltage DC. A pair of conductors 19 and 20 are connected to the low voltage DC for connecting low voltage lamps (not shown) thereto.

FIG. 2 shows a known ignition circuit 30 for an AC-DC or AC-AC inverter 31 that is coupled to the output of a bridge rectifier 32 and whose ignition is based on an RC circuit 33 and a trigger diode 34, used for instance for powering a low-voltage filament lamp 35. The RC circuit 33 includes a capacitor 36 that is charged via a resistor 37. Upon the trigger diode reaching a breakdown voltage, the capacitor 36 is discharged through a drive transformer (not shown), leading to ignition.

Also shown in FIG. 2 is a dimmer 38 whose output is coupled to the input of the bridge rectifier 32 for varying the brightness of the lamp 35. When the inverter 31 is used with a leading or forward edge control switch (F-dimmer), in parallel to the RC circuit 33, an accelerator circuit 39 is coupled to the output of the bridge rectifier and feeds an acceleration signal to the inverter 31 to speed up the ignition process, thus leading to a better synchronization of the ignition process with the dimmer's cut-on.

It is important to note that in such schemes the inverter is not active between the dimmer cut-off and following cut-on. This leads to the absence of a load on the dimmer, which is a drawback of this dimmer-inverter system. Additional drawbacks relate to the instability of the switching moment relative to the zero crossing of the input voltage, which depends on the inverter load, length of connecting wires, capacitance of the input filter, capacitance in the inverter's input bridge, etc.

Moreover, as is explained below in greater detail, the presence of the passive state of the inverter prior to ignition causes a number of parasitic processes which desynchronize the inverter and destroy the normal functioning of the dimmer, which in turn harm the functioning of the whole dimmer-inverter system.

It is also known that the presence of sharp current fronts in operation of the dimmer is one of the causes of mechanical vibration of the lamp, which leads to acoustic noise. Various methods are known to reduce noise based on shaping of the forward front of the leading edge dimmer, or on utilizing the energy stored in a large capacitor for spreading the backward front in the case of the trailing dimmer. In the latter case, during the cut-off of the backward front there arises an additional current in the capacitor during the time of its discharge which leads to large mechanical vibration of the capacitor which again causes acoustic noise. As a result, reduction of the acoustic noise in the lamp is replaced by acoustic noise in the capacitor.

An additional drawback of the dimmer inverter system is the fact that the inverter must be designed to work either with the leading edge dimmer or the trailing dimmer, or must be provided with a circuit that is able to determine the dimmer type and can change its operation accordingly. However, if the dimmer type is determined incorrectly, very high acoustic noise and large shocks can arise in inverter circuits. For instance, it may happen that the leading edge dimmer will function without the shaping of the forward front with a large capacitance in the input bridge, which will lead to additional currents in the inverter and dimmer and large vibration and acoustic noise of the capacitor.

WO 03/058801 published Jul. 17, 2003 in the name of the present applicant and entitled "*Lamp transformer for use with an electronic dimmer and method for use thereof for reducing acoustic noise*" discloses a controller for reducing acoustic noise produced during use of a leading edge dimmer. A leading edge controller responsive to an input voltage fed thereto produces a control signal upon detection of a leading edge and a linear switch is coupled to the leading edge controller and is responsive to the control signal for linearly switching the input voltage so that a rate of rise of the leading edge is decreased. A trailing-edge controller may be coupled to a leading-trailing edge detector so as to be responsive to detection of a trailing edge dimmer for disabling the leading edge controller and decreasing a rate of decline of the trailing edge of the input voltage by using, for example, a large capacitor, as described earlier.

FIG. 3 shows schematically a further dimming problem that is associated with the connection of the inverter 31 to the output of the bridge rectifier 32 in the circuit shown in FIG. 1. The input to the inverter is capacitive owing to the presence of a large smoothing capacitor 40 that is typically connected across the output of the bridge rectifier. The input to the bridge rectifier is also capacitive owing to the presence of an EMI filter 41 across the supply output. During the inactive part of the period, i.e. when the inverter is not conductive, the capacitor 40 is charged and causes ignition to be late and unstable. In addition, charge on the capacitor 40 may trigger ignition of the inverter prior to ignition of the dimmer. This may cause several undesired scenarios:

The inverter may cause early ignition of the dimmer and change its ignition angle;

By the time the dimmer ignites, the inverter switches off, not having enough energy to sustain normal operation. Owing to the required latency, it will re-ignite late;

The early ignition of the inverter, having a nature of a fluctuation, may cause a spike in the output of the dimmer which may in turn lead to another unwanted re-ignition of the inverter.

All these processes, being dependent on a multitude of external parameters such as ignition angle, inverter load, ambient conditions, etc. will lead to unstable operation of the system, when a dimmer is connected, in one of the described modes.

Furthermore, when the inverter is used with a leading edge dimmer, an accelerator circuit is employed to speed up the ignition process. In such schemes the inverter is not active between cut-off and subsequent cut-on of the dimmer. This leads to a loss of load on the dimmer, which is undesirable since it created flickering at the lamp and it enhances dimmer noise.

It is commonly known that shock currents are created in AC-AC and AC-DC converters during start-up, when such converters are used to power filament lamps, or any other lamp with starting characteristics similar to filament lamps. These currents are caused by the fact that the resistance of cold lamps is very low so that the converter works with what is effectively a short-circuited load. These shock currents reduce expected life of the lamp. Peak currents can reach high values.

FIG. 4 shows graphically a waveform of a soft start voltage $V_{CS}$ derived from a soft capacitor $C_S$ that is applied to a switching MOSFET and an output voltage $V_{mo}$ of an arithmetic circuit that calculates an output voltage that is a function of the output voltage of a boost converter that forms part of the power factor correction circuit. The output voltage $V_{mo}$ follows the AC line voltage and represents an envelope that is sampled using pulse width modulation (PWM) when the voltage $V_{Cs}$ across the soft capacitor intersects the envelope. FIG. 4*b* shows graphically a waveform of successive current spikes that are fed by the soft start circuit to the inverter and the average input current. Thus, it is seen that the instantaneous inverter voltage follows the line voltage, but since only discrete samples of the line voltage are fed to the inverter at time intervals dependent on the duty cycle of the PWM, the average inverter voltage is lower than the line voltage. Two properties emerge from this: first, during any given AC half cycle, repeated voltage pulses are fed to the inverter; and secondly the amplitude of each voltage pulse is equal to the instantaneous peak voltage of the line voltage at the time that the line voltage is sampled.

From the foregoing it emerges that control of prior art lamp power supplies requires customized control of the inverter, thus militating against use of off-the-shelf prior art inverters. Likewise, the problems associated with shock currents caused by ignition of filament lamps allow for improvement in the soft start circuit used to reduce these phenomena. Furthermore, so far as power supplies that operate with dimmers are concerned, there remains the problem of acoustic noise whose reduction is amenable to further improvement; and the discontinuous ignition of the inverter and resulting instability of the inverter-dimmer-load system calls for improvement.

SUMMARY OF THE INVENTION

It is therefore an object of the present invention to provide an improved power supply for low voltage illumination circuits, which addresses key shortcomings associated with hitherto-proposed power supplies as discussed above.

This object is realized in accordance with a first aspect of the invention by a method for reducing acoustic noise produced during use of a lamp leading edge dimmer, the method comprising:

(a) determining a nominal firing time of the leading edge dimmer; and (b) applying a post-correction to a voltage applied to the dimmer starting from said nominal firing time so as to build-up the voltage gradually during a predetermined post-correction time period and thereby reduce the rate of rise of the leading edge thereof.

According to a further aspect of the invention there is provided a method for reducing acoustic noise produced during use of a lamp trailing edge dimmer, the method comprising:

(a) determining a nominal cutoff time of the trailing edge dimmer; and (b) applying a pre-correction to a voltage applied to the dimmer starting from said nominal cut-off time so as to diminish the voltage gradually during a predetermined pre-correction time period and thereby reduce the rate of rise of the leading edge thereof.

According to yet a further aspect of the invention there is provided a method for reducing acoustic noise produced during use of a lamp dimmer, the method comprising:

(a) detecting whether the dimmer is a leading edge dimmer or a trailing edge dimmer;

(b) if the dimmer is a leading edge dimmer:

i) determining a nominal firing time of the leading edge dimmer; and ii) applying a post-correction to a voltage applied to the dimmer starting from said nominal firing time so as to build-up the voltage gradually during a predetermined post-correction time period and thereby reduce the rate of rise of the leading edge thereof;

(c) if the dimmer is a trailing edge dimmer:

i) determining a nominal cutoff time of the trailing edge dimmer; and ii) applying a pre-correction to a voltage applied to the dimmer starting from said nominal cut-off time so as to diminish the voltage gradually during a predetermined pre-correction time period and thereby reduce the rate of rise of the leading edge thereof.

According to a further aspect of the invention there is provided a method for soft starting a lamp power supply for use with a filament lamp, the method comprising:

(a) during successive AC half cycles applying voltage slices starting from zero voltage; and (b) increasing the duration of said voltage slices during successive AC half cycles while ensuring that a filament current flowing through a filament of the lamp does not exceed a predetermined threshold prior to ignition of the filament lamp.

According to a further aspect of the invention there is provided a method for igniting an inverter in a power supply circuit that has an input capacitance and that has a load coupled to an output of the inverter and in which an AC supply voltage is fed to the inverter via a dimmer circuit coupled to a bridge rectifier, the method comprising:

(a) feeding rectified dimmer voltage to an input of the inverter;

(b) continually feeding ignition pulses to the inverter until a magnitude of the rectified dimmer voltage to an input of the inverter must reach a specific level; and (c) when the magnitude of the rectified dimmer voltage fed to the input of the inverter reaches said specific level:

i) discharging the dimmer voltage across the input capacitance via the inverter to the load; and ii) interrupting said ignition pulses to the inverter.

According to a further aspect of the invention there is provided a method for simulating operation of a leading voltage edge dimmer so as to feed a controlled input voltage to an inverter coupled via bridge rectifier to the dimmer, the method comprising:

(a) determining a maximum jitter angle Δt of a leading edge of the dimmer; and (b) switching the inverter with a time delay larger than the maximum jitter angle Δt relative to the input voltage.

BRIEF DESCRIPTION OF THE DRAWINGS

In order to understand the invention and to see how it may be carried out in practice, a preferred embodiment will now be described, by way of non-limiting example only, with reference to the accompanying drawings, in which:

FIG. 6*b* is a simplified circuit diagram of the inverter ignition circuit illustrated in FIG. 5;

FIGS. 7*a* to 7*d* show graphically voltage waveforms of the input voltage and ignition pulses associated with the ignition circuit shown in FIG. 5;

FIGS. 11*a* to 1l*f* show functionally trailing edge dimmers corrected for acoustic noise and associated graphical voltage waveforms using conventional approaches and according to the invention.

DETAILED DESCRIPTION OF EXEMPLARY EMBODIMENTS

Figure 5:
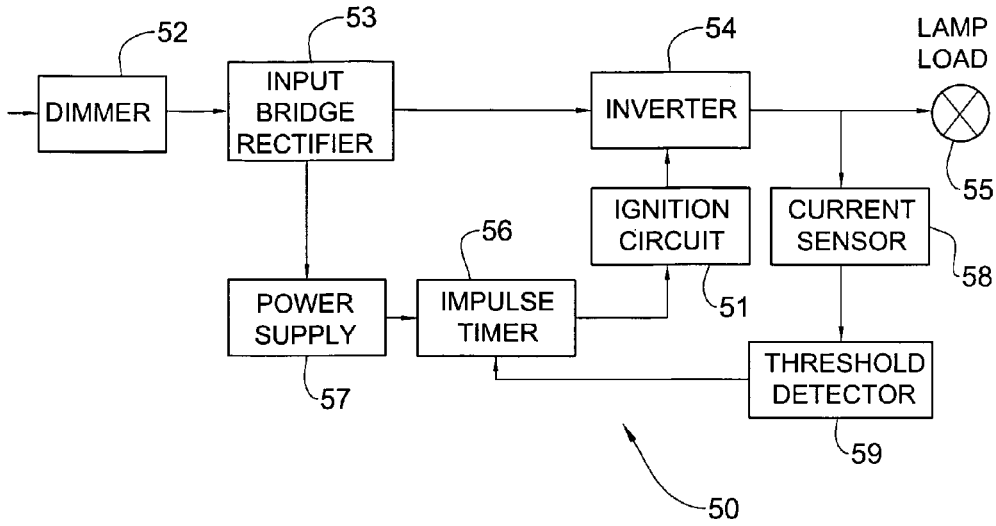
FIG. 5 is a block diagram showing functionally a power supply according to the invention having an improved inverter ignition circuit.

FIG. 5 is a block diagram showing functionally a variable power supply circuit according to the invention shown generally as 50 having an improved inverter ignition circuit 51 for use with a current feedback inverter. Regardless of the application for which the inverter is required, such an inverter must be ignited by an ignition pulse. The power supply 50 comprises a dimmer 52 coupled to the input of an input bridge rectifier 53, whose output is coupled to an inverter 54 in known manner for producing an output voltage that is fed to a lamp 55. The ignition circuit 51 is controlled by an impulse timer 56 energized by an energy accumulator circuit 57 and responsively coupled to a current sensor 58 and threshold detector 59.

Figure 6A:
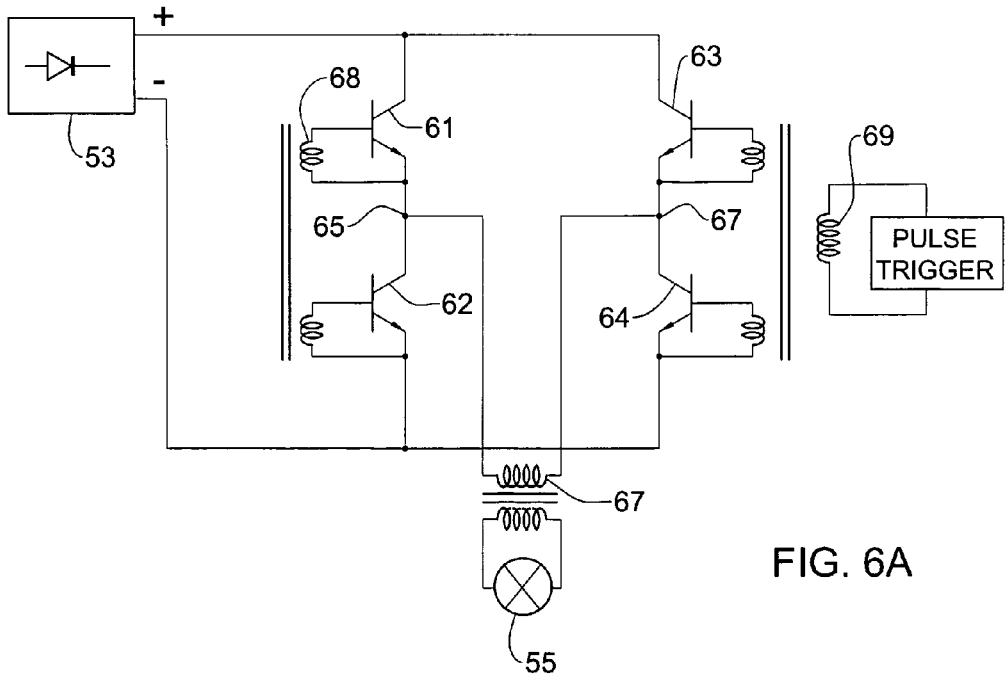
FIG. 6*a* is a circuit diagram showing schematically a detail of the inverter ignition circuit illustrated in FIG. 5.

FIG. 6*a* is a circuit diagram showing schematically a detail of the inverter ignition circuit 51 illustrated in FIG. 5. The inverter comprises a bridge of four bipolar NPN junction transistors 61, 62, 63 and 64. The collectors of the transistors 61 and 63 are commonly connected to the positive supply rail of the bridge rectifier 53, while the emitters of the transistors 62 and 64 are commonly connected to the negative supply rail of the bridge rectifier. The emitter of the transistor 61 is connected to the collector of the transistor 62 at junction 65. Likewise, the emitter of the transistor 63 is connected to the collector of the transistor 64 at junction 66. The lamp 55 is coupled via a current transformer 67 across the junctions 65 and 66. Respective current transformers primary windings shown as 68 wound on a common core are each coupled between the base and emitter of a respective one of the transistors. The ignition circuit 56 is coupled via a secondary winding 69 to the primary windings of the current transformers so as to feed base trigger pulses to the four transistors.

When the inverter input voltage falls below a predetermined threshold, the inverter stops conducting and must be re-ignited when the input voltage is high enough. To this end, a series of high frequency ignition pulses is applied at the start of the AC half cycle until the inverter is ignited when the ignition pulses are interrupted.

FIG. 6*b* shows in simplified form the power supply circuit 50 depicted in FIG. 5. Associated with the bridge 53 is a filter capacitor $C_f$ and associated with the inverter is a capacitance $C_{inv}$. Since these two capacitances are connected in parallel, the total input capacitance associated with the circuit is given by:

$$C=C_f+C_{inv}$$

FIG. 7*a* shows graphically the dimmer voltage $V_c$ across the input capacitance of the power supply in temporal relationship to the ignition voltage $V_{ign}$ fed to the inverter 54 shown graphically in FIG. 7*b*. FIG. 7*c* shows graphically the inverter voltage in temporal relationship to the waveforms shown in FIGS. 7*a* and 7*b* and in temporal relationship to the detector voltage shown graphically in FIG. 7*d*. The form of the dimmer voltage $V_c$ is initially dependent on the characteristic of the dimmer and rises until its magnitude reaches the threshold voltage $V_{Gen}$ of the threshold detector 59. Until this happens, high frequency ignition pulses as shown in FIG. 7*b* are continually fed to the ignition circuit 51, but the inverter 54 cannot conduct until its input voltage exceeds a specific level. The threshold detector 59 is so calibrated that when the magnitude of the detector voltage $V_{det}$ reaches a predetermined threshold voltage $V_T$, the voltage at the input to the inverter is of sufficient magnitude to allow ignition of the inverter. When this happens, the impulse timer is disabled from feeding further ignition pulses to the ignition circuit 51. It is seen that in practice only a single ignition pulse shown in FIG. 7*b* is applied to the inverter after ignition and for the remainder of the conduction cycle, no further ignition pulses are fed to the inverter while it conducts until the detector voltage falls below the threshold, when the inverter stops conducting and ignition pulses are again fed to the inverter ignition circuit. The frequency of the ignition pulses must be sufficiently high to ensure that the input capacitance of the dimmer-inverter circuit is discharged once the inverter becomes active thus preventing the influence of the input capacitance from being transferred by the inverter to the load.

Once the inverter 54 is ignited and starts to conduct, the dimmer voltage across the input capacitance is discharged via the inverter 54 to the load 55. This avoids the problem noted above with regard to conventional circuits, where the recharging of the input capacitance interrupts the dimmer inverter system from functioning properly giving rise to jitter.

It is clear from the foregoing that for the inverter 54 to start conducting, two basic conditions must be fulfilled:

1) The rectified dimmer voltage fed to the input of the inverter must reach a specific level; and
2) Ignition pulses must be fed to the inverter.

If the input capacitance is not discharged properly, one or a combination of two phenomena will occur:

1) When the above mentioned input capacitance (which is also found at the output of the dimmer) is charged it will change the ignition angle of the dimmer. This will affect the stability of the dimmer angle.
2) High level voltage charging of the same input capacitance can cause premature generation of the inverter (before dimmer ignition). However, the inverter does not have sufficient energy to continue working because its energy source was only short-term energy stored in the input capacitance rather than continual dimmer energy. After inverter cut-off, the inverter cannot always begin generating right away. At the same point of dimmer ignition the inverter is not ready to begin generating.

It is important to mention that the above process is not always stable which will lead to the jittering of the load's energy. This manifests itself by flickering when using Halogen or Tungsten Halogen lamps.

If a high frequency ignition source is used, then as soon as the inverter begins to generate, the system will automatically begin to discharge the capacitance to load.

The circuit shown in FIG. 5 offers the following advantages:

stability of the inverter-dimmer-load system,
ability to activate the inverter at the minimal phase angle in a circuit having no dimmer (reducing the ignition shock and increasing the duty factor),
no need for special synchronization circuit of a leading edge dimmer,
no need for special circuits loading the dimmer since the active load of the dimmer is now the inverter itself.

Figure 8:
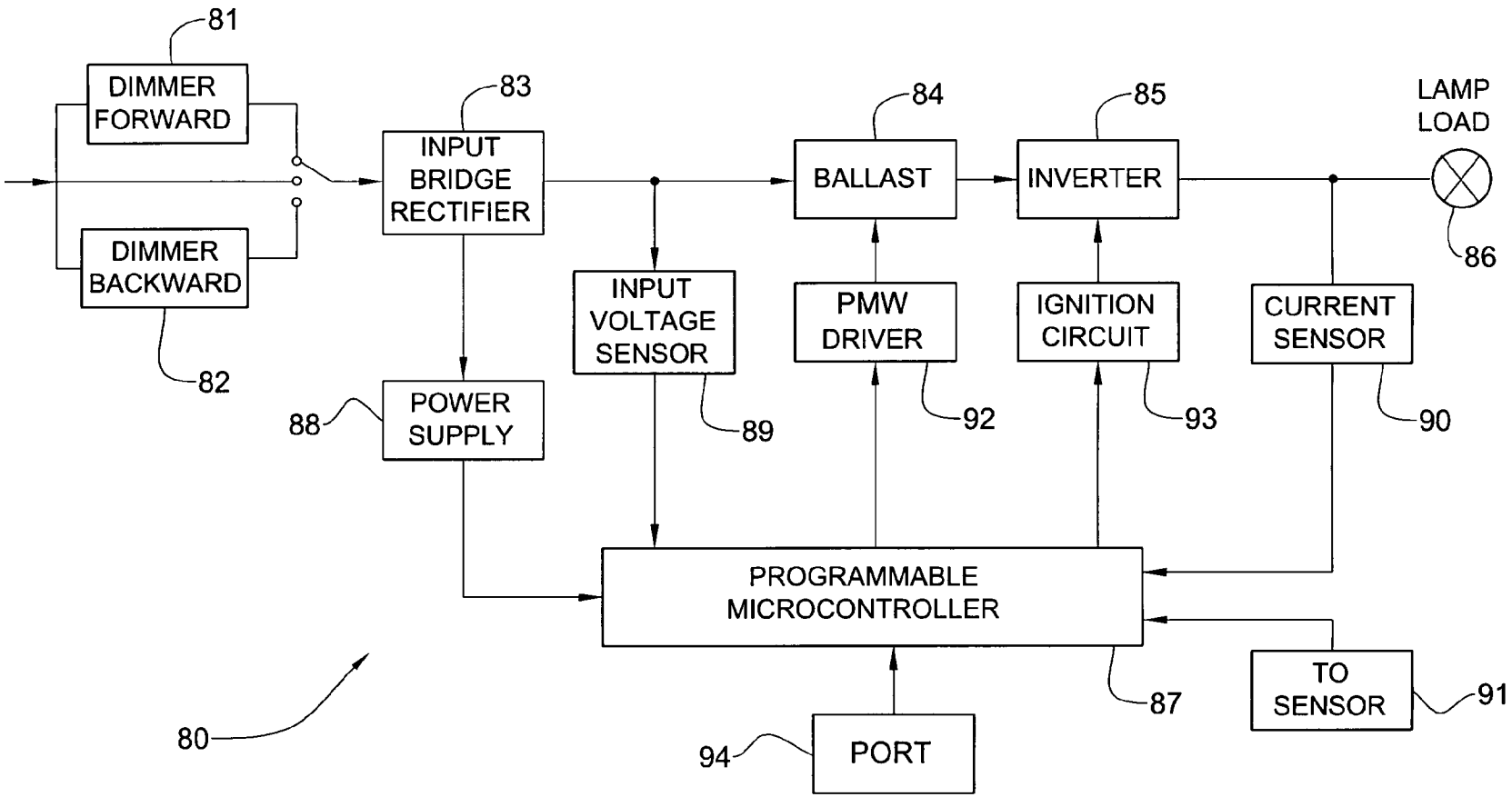
FIG. 8 is a block diagram showing functionally a power supply according to the invention having an externally controlled ballast.

FIG. 8 is a block diagram showing functionally a "smart" power supply 80 according to the invention comprising a leading edge dimmer 81 and a trailing edge dimmer 82 switchably coupled to a bridge rectifier 83 to which there are coupled a ballast 84 and an inverter 85 for feeding a lamp load 86 in known manner. The ballast 84 is controlled directly by a programmable controller shown as 87, which also serves to feed ignition signals to the inverter 85. The programmable controller 87 is powered by a power supply 88 coupled to a DC output of the bridge rectifier 83 and receives as input signals a voltage reference $V_{in}$ corresponding to an estimate of the rectified AC voltage at the output of the bridge rectifier 83 as determined by a voltage sensor 89; a current reference $I_{out}$ corresponding to the output current fed to the lamp 86 as determined by a current sensor 90; and an ambient temperature signal $t_o$ sensed by an external temperature sensor 91. A first output of the programmable controller 87 is fed to a PWM driver 92 for feeding PWM control signals to the ballast 84. A second output of the programmable controller 87 is fed to an ignition circuit 93 for feeding ignition signals to the inverter 85. An external port 94 feeds an input signal to the programmable controller 87 and allows control parameters to be fed externally for modifying the behavior of the controller 87. By such means the controller 87 can be customized in accordance with a specific user's requirements without requiring any changes to be made to the power supply circuit.

The programmable controller 87 is programmed to feed a constructed voltage waveform to the inverter so as to reduce acoustic noise caused by the dimmers and also to allow for soft starting of filament lamps. The manner in which this is done will now be explained with particular reference to FIGS. 9 to 14. The controller 87 controls the ballast directly so that all that is fed to the inverter by the ballast is the firing pulse. Since all the control such as soft start, leading and trailing dimmer edge control, is done via the ballast this allows any off-the-shelf inverter to be used and to operate at 50% duty cycle and firing pulses to be fed thereto. In an emergency, such as a short circuit fault, when it is necessary to interrupt the inverter without delay, the controller 87 applies an interruption signal directly to the inverter, to one of the gates of the inverter transistors.

Figure 9:
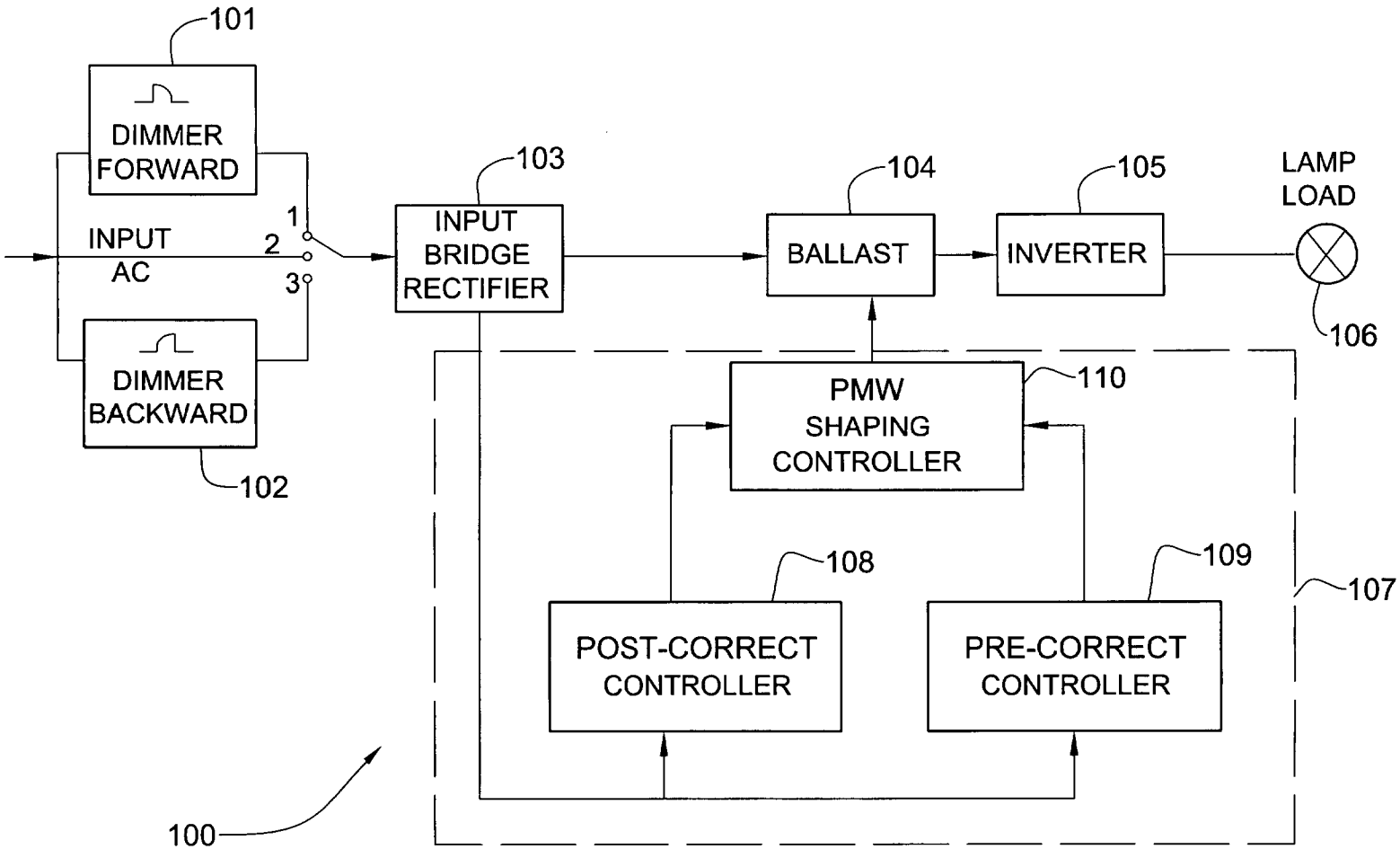
FIG. 9 is a block diagram showing functionally a power supply according to the invention having a correcting ballast for reduction of acoustic noise.

FIG. 9 is a block diagram showing functionally a power supply 100 according to the invention having a correcting ballast for reduction of acoustic noise. The power supply 100 comprises a leading edge dimmer 101 and a trailing edge dimmer 102 switchably coupled to a bridge rectifier 103 to which there are coupled a ballast 104 and an inverter 105 for feeding a lamp load 106 in known manner. The ballast 104 is controlled directly by an external controller shown as 107 that comprises a post-correction control unit 108 and a pre-correction control unit 109 both of which feed control signals to a PWM shaping control unit 110 that feeds PWM control signals to the ballast. The post-correction control unit 108 operates in conjunction with a leading edge dimmer, while the pre-correction control unit 109 operates in conjunction with a trailing edge dimmer for correcting the respective leading or trailing edges of the current waveform applied to the ballast 104.

Control of the ballast 104 is effected by determining which of the edges (leading, trailing, or both) is distorted, finding the phase angle of dimmer switch-on/switch-off, and calculating the phase angle of the ballast that is needed to provide the proper degree of correction to obtain the required smooth shape of the load current. Thus, if the dimmer is a leading (rising) edge dimmer, there will be no voltage until the dimmer fires. Therefore, instead of a smooth, continuous rise in voltage, the leading edge may be seen as distorted owing to the sudden discontinuity from no voltage to the instantaneous AC supply voltage at the angle of firing. Conversely, if the dimmer is a trailing (falling) edge dimmer, the leading edge will show a smooth, continuous rise in voltage but there will be no voltage after the trailing front of the dimmer voltage falls down. Therefore, instead of a smooth, continuous fall in voltage, the trailing edge may be seen as distorted owing to the sudden discontinuity from instantaneous AC supply voltage to no voltage at the fall down angle of the dimmer.

Having thus determined whether the dimmer is a leading or a trailing edge dimmer, the phase angle of switch-on/off of the dimmer is determined. For both types of dimmer, the AC period is measured and the instant where the voltage crosses the time axis may also be monitored. For a leading edge dimmer the phase angle may be determined by measuring the time from firing until the voltage crosses the time axis and subtracting the measured time from the half-period (i.e. the time for the AC half-cycle). A trailing edge dimmer starts conducting when the AC input voltage crosses zero, so in this case the phase angle is simply the measured time from the start of the AC half cycle until the fall down voltage. Calculation of the phase angle of the ballast for providing the proper degree of correction to obtain the required smooth shape of the load current and protection requirements, must take into account such parameters as previous dimmer jitter, detector filter delay, noise, load level, previous dimmer optimal firing conditions, start up requirements etc. For example, in a leading edge dimmer, firing jitter of the dimmer plays an important contribution to the delay (Δt), and therefore post-correction is required so that the ballast is always rises at the latest possible time i.e. t+Δt. This principle is explained in greater detail below with reference to FIG. 10*g* of the drawings, which shows that the ballast starts to conduct immediately at dimmer switch on with some (low) transfer factor and rises at the calculated time. In a trailing edge dimmer, the opposite applies and pre-correction is required so as to avoid jitter by ensuring that the ballast falls down at the earliest possible time i.e. t−Δt. This principle is explained in greater detail below with reference to FIG. 11*f* of the drawings. In both cases it is thereby ensured that the ballast is always conductive with some transfer factor when the dimmer is operative and avoids the possibility that the dimmer might attempt to conduct via an absent load. The determined input parameters include phase angles of the leading and trailing edges of the input voltage and are used for calculating the internal quasi dimmer angle, soft start times etc. of the ballast controller 107.

It should be noted that although the controller 107 is shown in FIG. 9 as external to the leading and trailing edge dimmers, it may be integral therewith such that the dimmer circuitry is part of the controller. In the case where the controller is external to the dimmers, it is necessary to determine whether the dimmer is a leading or trailing edge dimmer as described above in order that the controller 107 may know whether to apply post- or pre-correction, soft start direction, some coefficients etc. These terms are described in more detail below with reference to FIGS. 12 to 14 of the drawings. However, there may be occasions when the act of determining whether the dimmer is a leading or trailing edge dimmer is unnecessary: for example if the controller is integral with a dimmer of known type. In this case, of course, the controller 107 may be of simpler construction since there is then no need to provide both a post-correction control unit 108 and a pre-correction control unit 109: only one of these being required depending on the type of dimmer for which the controller 107 is configured. In saying this, however, it is to be noted that the ballast may also be configured for use with a combined leading/trailing edge dimmer, where both leading and trailing edges of the input voltage are distorted, in which case both a post-correction control unit 108 and a pre-correction control unit 109 may be required. In such a combined leading/trailing edge dimmer having distortion of both leading and trailing edges of the input voltage, firing (rising) occurs after the line voltage has crossed the time axis and fall down occurs before it crosses the time axis, so that neither period nor phase angle may be measured by means of zero crossing point. However, period may be measured as the time between successive firings, which are easily determined as the instant where voltage changes from zero to non-zero. In practice, a clock may be used in conjunction with a pair of monostables to generate a pair of mutually synchronized pulse trains, one of whose rising edge starts in synchronism with firing and the other of whose rising edge starts in synchronism with fall down. The difference between the respective rising edges of corresponding pulses in the two pulse trains then corresponds to the instantaneous phase angle of the dimmer, it being understood that this may vary between successive pulses owing to jitter, for example.

Post-correction of the leading edge may be applied from the moment of switching the dimmer on, i.e. for the AC half cycle. However, it is not possible to apply pre-correction to the first AC cycle since the trailing edge must occur before it can be detected, and only after it is detected can the required amount of pre-detection be applied. So in practice, the amount of pre-correction that is calculated for each AC cycle is applied at a time T−Δt after the trailing edge of the current cycle to the next AC cycle, where T is the period and Δt is the required pre-correction. In all cases, it will be understood that the pre- and post-correction units may be implemented using discrete electronics or via a suitably programmed microprocessor or in firmware.

Figure 10A:
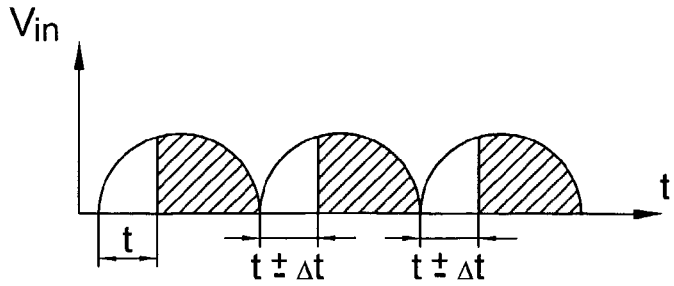
FIGS. 10A to 10G show graphically voltage waveforms associated with the ballast shown in FIG. 9.

FIG. 10*a* shows the rectified AC voltage applied to the inverter 105 by the leading edge dimmer 101 when no post-correction is applied. Thus, depending on the firing angle of the dimmer 101, a sharp, almost instantaneous, voltage rise occurs when the dimmer is fired. However, the time at which this occurs, known as the firing angle, may vary from one half-cycle to another, particularly when a low quality is used. Thus, the firing angle for the first half-cycle is t while the respective firing angles for the next two half-cycles are t±Δt. The maximum time Δt between the nominal firing angle t and the actual firing angle is known as the jitter of the dimmer. Moreover, the dimmer may even fail to fire altogether as shown in FIG. 10*c* where the dimmer does not operate in the third half-cycle.

Figure 10B:
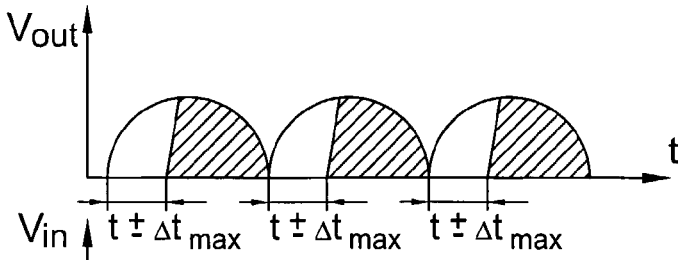
Figure 10C:
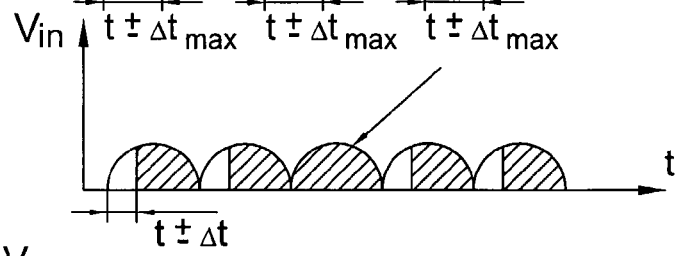
Figure 10D:
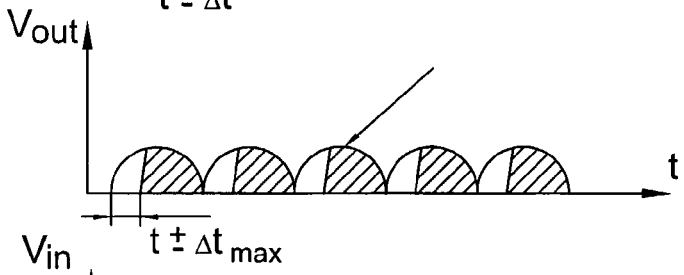

FIG. 10*b* shows graphically a ballast voltage according to the invention that simulates a firing pulse applied to a leading voltage edge dimmer 101. The ballast 104 is switched with a time delay relative to the input voltage, which must be larger than the time Δt of jitter of the leading edge, which completely eliminates the jitter in the load. Moreover, as shown in FIG. 10*d* in the case of occasional disappearance of the cut-off of the dimmer process (owing to unstable operation of the dimmer), the controller continues to operate the ballast at the calculated times (internal quasi-dimming mode). Moreover, the sharp voltage rise shown in FIG. 10*a* associated with conventional dimmers is avoided by building up the voltage gradually after firing during a short post-correction period after which the voltage waveform resumes its original shape at time t+Δt.

In the case of a trailing edge dimmer 102 according to the invention, the ballast 104 is switched with a time advance relative to the backward front of the input voltage. The time advance is calculated as a sum of the pre-correction time necessary for forming a smooth drop of the load current and the maximum jitter angle of the backward front of the input voltage. In the case of occasional disappearance of the trailing edge (owing to unstable operation of the dimmer), the controller continues to operate the ballast at the calculated times (internal quasi-dimming mode) as shown in FIG. 10*d*.

Figure 10E:
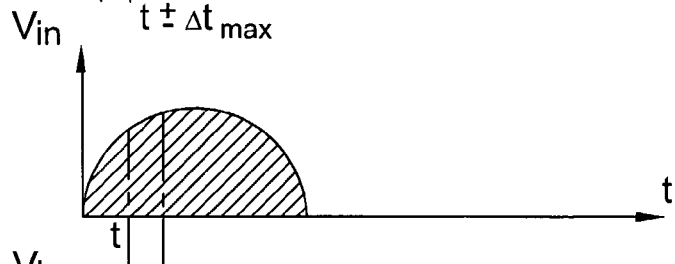
Figure 10F:
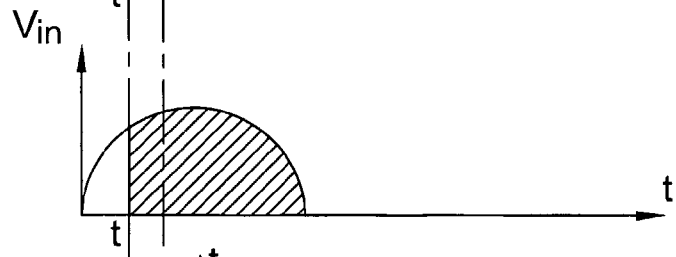
Figure 10G:
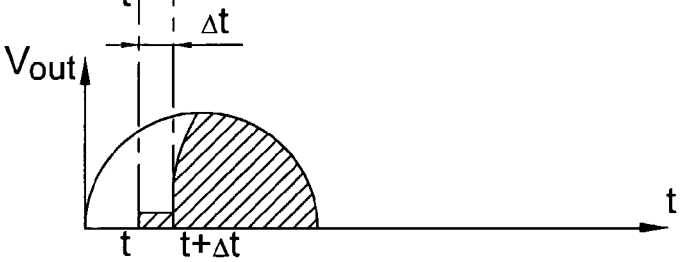

FIG. 10*e* shows graphically the dimmer voltage when firing does not occur so that the AC half cycle continues uninterrupted. FIG. 10*f* shows graphically the dimmer voltage when normal firing occurs at a time t. As noted above the firing angle of the dimmer can vary by ±Δt. FIG. 10*g* shows graphically the simulated voltage applied by the ballast to the inverter. Thus, at time t, the ballast applies a very small voltage to the inverter and after the time interval Δt it applies the full input voltage so that the inverter output voltage reaches maximum level. By such means, the dimmer is simulated to fire at its maximum firing angle t+Δt while avoiding jitter that would occur without the application of the small voltage step at time t.

Figure 11A:
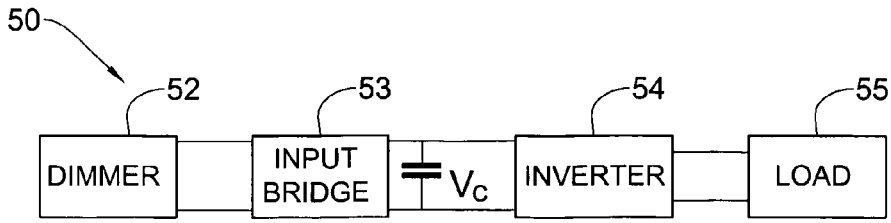

FIG. 11*a* shows again in simplified form the conventional power supply circuit 50 depicted in FIG. 5 for use with a trailing edge dimmer, where acoustic noise is reduced using a capacitor $V_c$ as known in the art for storing energy while the dimmer conducts and which discharges when the dimmer stops conducting so as to avoid an abrupt drop in voltage. In a conventional dimmer the capacitor $V_c$ operates on the principle of storing sufficient energy so as to feed power to the load for some time after interruption of the input voltage and thus avoid abrupt disruption of voltage which would cause noise.

Figure 11B:
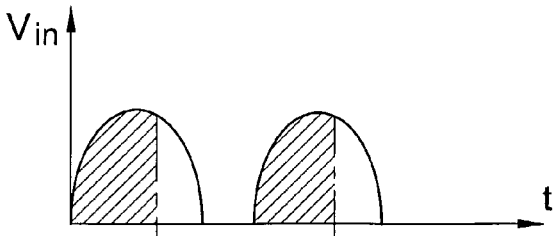
Figure 11C:
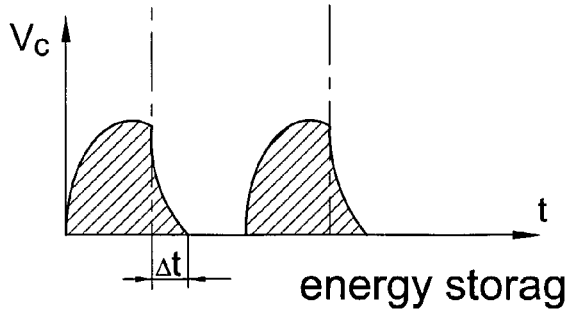

FIG. 11*b* shows graphically the dimmer voltage $V_c$ in temporal relationship to the inverter voltage $V_c$ fed to the inverter as shown graphically in FIG. 11*c* according to the conventional approach. Thus, it is seen that in the conventional approach the capacitor must be sufficiently large to supply voltage to the inverter for some time after firing the trailing edge dimmer so that it stops conducting. Since the capacitor serves as an energy source, it must have sufficient capacitance to store energy from the mains prior to voltage interruption. The larger the capacitance, the more energy it will store and the longer it will take to discharge and the less will be the noise in the load. For a 300 W dimmer, the capacitor must have a capacitance of approximately 3 to 7 μF.

Figure 11D:
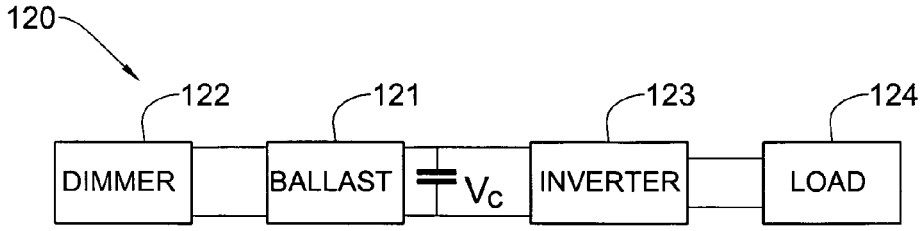

FIG. 11*d* shows in simplified form a modified power supply circuit 120 for use with a trailing edge dimmer (not shown), where acoustic noise is reduced using a pre-correction ballast 121. The ballast 121 is connected to the output of a bridge rectifier 122 and to the input of an inverter 123 whose output is connected to a load 124. A capacitor $V_C$ is connected across the output of the ballast 121. It will be seen that the difference between the conventional circuit 50 depicted in FIG. 11*a* and the modified circuit 120 depicted in FIG. 11*d* resides in the ballast 121, which is used to control the inverter 123 as will now be explained.

Figure 11E:
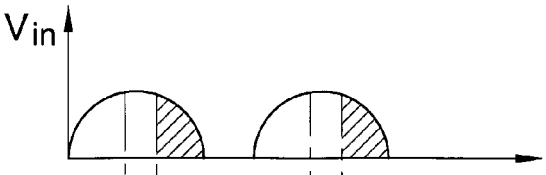
Figure 11F:
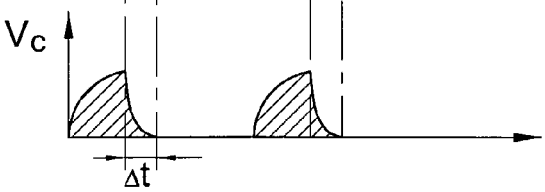

FIG. 11*e* shows graphically the dimmer voltage $V_c$ in temporal relationship to the inverter voltage $V_C$ fed to the inverter as shown graphically in FIG. 11*f* according to the invention. The principle of operation is different to that of the conventional trailing edge dimmer as explained above with reference to FIGS. 11*a* to 11*c* of the drawings. Specifically, it is known when the dimmer will cut-off since the firing angle is easily determined. In this case, the controller in the ballast fires the dimmer slightly before-hand so that it stops conducting and then feeds the stored energy in the capacitor until it is completely discharged. In this case, the capacitance of the capacitor must be such that, after firing the trailing edge dimmer, voltage continues to be fed to the inverter until the time at which the dimmer would normally have been fired. Since the actually firing of the dimmer is controlled by the controller to occur before actual firing such that the input voltage is not yet interrupted, voltage continues to be supplied from the AC mains supply. Consequently, the capacitor $V_C$ does not need to store voltage to energize the load after firing and may therefore be of significantly lower capacitance than the conventional approach. Specifically, for a 300 W dimmer, the capacitor $V_C$ must have a capacitance of approximately 0.1 to 0.5 μF—i.e. an order of magnitude less than for the conventional trailing edge dimmer.

Thus, in the pre-correction approach offered by the invention, the trailing edge dimmer stops conducting the full AC voltage slightly earlier in the rectified AC half cycle than would occur normally. In similar manner, a post-correction approach may be used for leading edge dimmers so that the dimmer starts to conduct the full AC voltage slightly later in the rectified AC half cycle than would occur normally. Therefore, in both cases slightly less average voltage is applied by the dimmer to the load. However, as against this there are the following advantages that are apparent for the trailing edge dimmer:

- no need for use of a large capacitor for correcting trailing edge dimmer;
- absence of electric shocks in the inverter;
- possibility to form optimal shape of the leading and/or trailing edges for minimization of acoustic noise and lamp flickering and maximization of energy transfer into the load;
- possibility of correction of any part of the period of the input voltage (leading edge, trailing edge, or both);
- internal quasi-dimming mode to correct occasional malfunctions of the dimmer;
- even if the dimmer type is determined incorrectly and the shaping of one of the edges is not performed, no large shocks will arise in the inverter because of the absence of the large capacitor.

In the case of distortion of both leading and trailing edges of the input voltage, both the pre- and post-correction of the forward and backward fronts are performed.

FIGS. 12 to 14 show graphically voltage waveforms associated with a soft start control circuit according to the invention for eliminating or at least reducing shock current caused by cold filament starting. The following description relates to the circuit 120 shown in FIG. 11*d* and assumes that the AC supply voltage is fed to a leading or trailing edge dimmer (not shown) whose output is connected to the bridge rectifier 122.

Figure 12A:
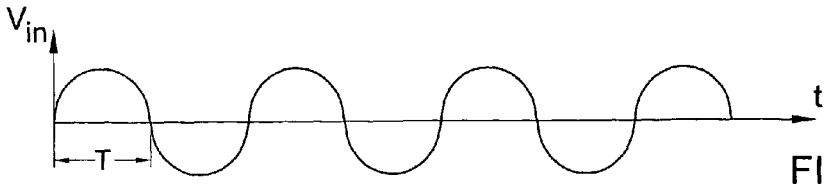
FIGS. 12A to 12H, 13A to 13D, and 14A to 14C show graphically voltage waveforms associated with a soft start control circuit according to the invention.
Figure 12B:
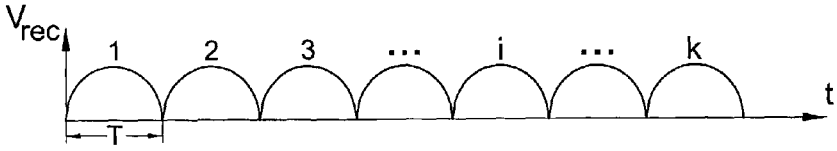
Figure 12C:
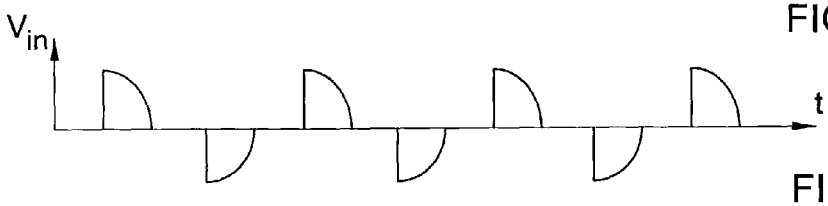
Figure 12D:
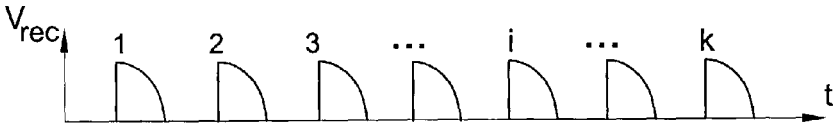

FIG. 12*a* shows the AC supply voltage waveform $V_{in}$ having a half-cycle period of T and FIG. 12*b* shows the rectified voltage waveform $V_{rec}$ at the output of the bridge rectifier 122. FIG. 12*c* shows the input voltage $V_{in}$ fed to the bridge rectifier 122 when a leading dimmer is used. Thus, the input voltage $V_{in}$ is zero until the dimmer is fired, whereafter it follows the AC half cycle shown in FIG. 12*a* until the AC supply voltage becomes zero, when the dimmer voltage is interrupted and remains zero until the dimmer is fired on the negative half cycle. FIG. 12*d* shows the rectified voltage $V_{rec}$ at the output of the bridge rectifier 122 corresponding to the rectified waveform of the input voltage $V_{in}$ shown in FIG. 12*c*.

Figure 12E:
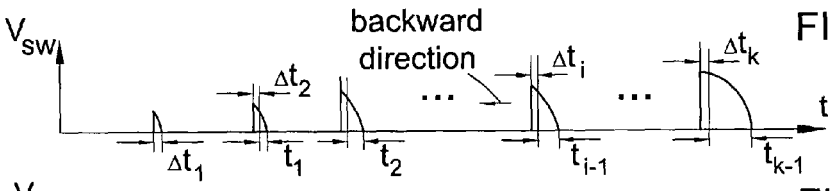

FIG. 12*e* shows an incremental starting voltage denoted $V_{sw}$ that is fed to the inverter and that follows the rectified voltage waveform $V_{rec}$ shown in FIG. 12*d* for successively longer time periods during successive half cycles of the input voltage. Thus, the starting voltage $V_{sw}$ is initially applied at a time $T-\Delta t_1$ for a time period of $\Delta t_1$ at the end of the first half cycle. During the second half cycle, the starting voltage $V_{sw}$ is applied at a time $T-(\Delta t_1+\Delta t_2)$ for a time period of $(\Delta t_1+\Delta t_2)$. During the third half cycle, the starting voltage $V_{sw}$ is applied at a time $T-(\Delta t_1+\Delta t_2+\Delta t_3)$ for a time period of $(\Delta t_1+\Delta t_2+\Delta t_3)$. In general, during the $n^{th}$ half cycle, the starting voltage $V_{sw}$ is applied at a time $$T-\sum_{1}^{n}\Delta t_n$$

for a period equal to $$\sum_{1}^{n} \Delta t_n,$$

the starting voltage always being applied toward the end of the respective half cycle for a trailing edge dimmer and increasing during successive half cycles until the filament lamp is properly ignited.

Figure 12F:
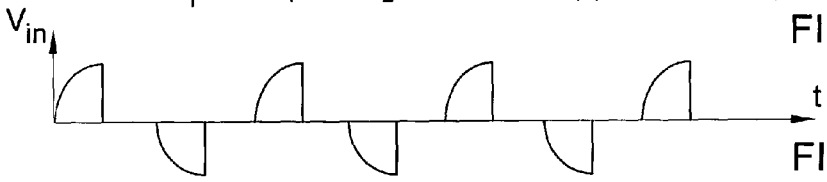
Figure 12G:
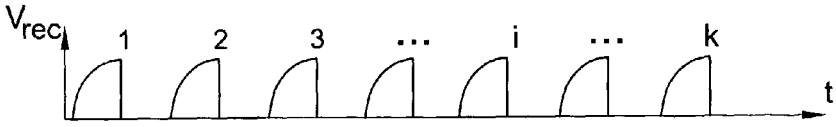

FIG. 12*f* shows the input voltage when a trailing edge dimmer is used. Thus, the input voltage follows the AC half cycle shown in FIG. 12*a* until the dimmer is fired, whereafter the dimmer voltage is interrupted and remains zero for the remainder of the AC half cycle. During the negative half cycle, the dimmer voltage again follows the negative AC half cycle until the dimmer is fired whereafter the dimmer voltage is interrupted and remains zero until the next positive half cycle. FIG. 12*g* shows the rectified voltage $V_{rec}$ at the output of the bridge rectifier 122 corresponding to the rectified waveform of the input voltage $V_{in}$ shown in FIG. 12*f*.

Figure 12H:
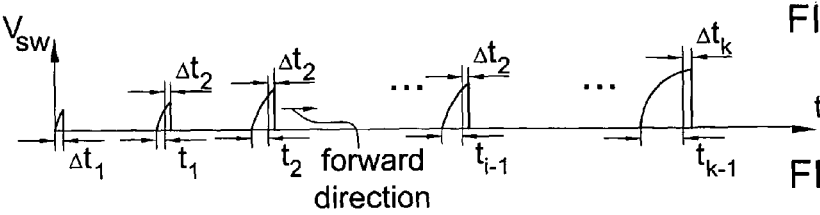

FIG. 12*h* shows an incremental starting voltage denoted $V_{sw}$ that is fed to the inverter and that follows the voltage waveform $V_{rec}$ shown in FIG. 12*e* for successively longer time periods during successive half cycles of the inverter voltage. Thus, the starting voltage $V_{sw}$ is initially applied at a time 0 for a time period of $\Delta t_1$ at the start of the first half cycle. During the second half cycle, the starting voltage $V_{sw}$ is applied at a time $\Delta t_1$ for a time period of $(\Delta t_1+\Delta t_2)$. During the third half cycle, the starting voltage $V_{sw}$ is applied at a time $(\Delta t_1+\Delta t_2)$ for a time period of $(\Delta t_1+\Delta t_2+\Delta t_3)$. In general, during the $n^{th}$ half cycle, the starting voltage $V_{sw}$ is applied at a time $$\sum_{1}^{n-1} \Delta t_n$$

for a period equal to $$\sum_{1}^{n} \Delta t_n,$$

the starting voltage always being applied at the start of the respective half cycle for a leading edge dimmer and increasing during successive half cycles until the filament lamp is properly ignited.

Figure 13A:
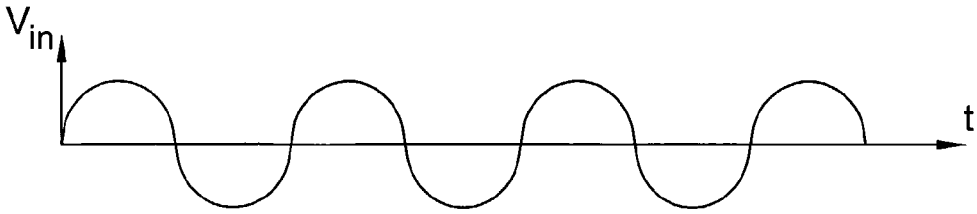
Figure 13B:
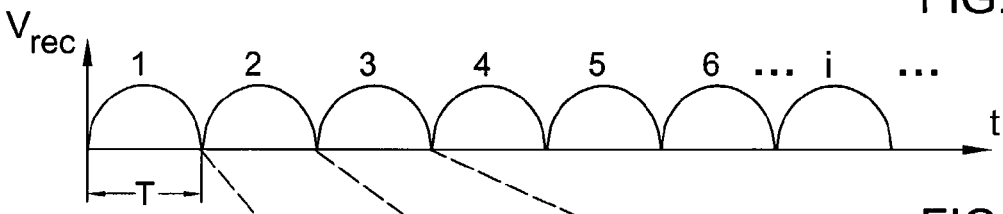
Figure 13C:
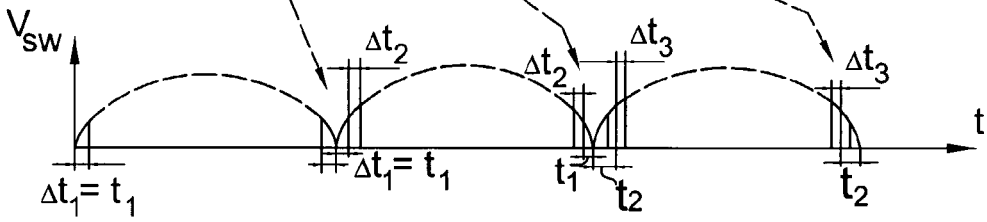
Figure 13D:
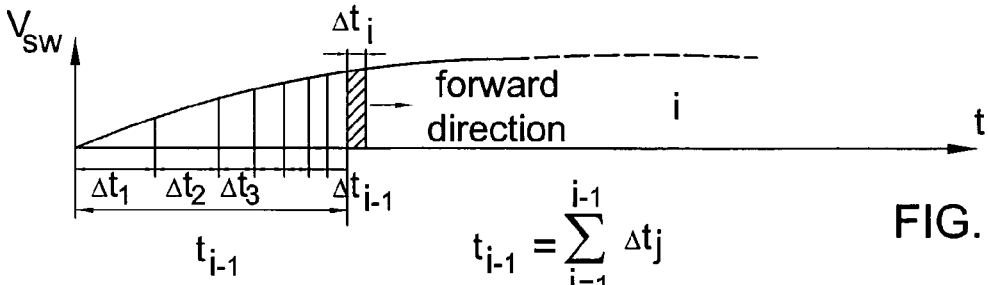

FIG. 13*a* shows again the AC voltage waveform $V_{in}$ having a half-cycle period of T and FIG. 13*b* shows the rectified voltage waveform $V_{rec}$ fed to the ballast 121. FIG. 13*c* shows at enlarged scale the inverter input voltage for either a trailing edge or a leading edge dimmer during successive half cycles. FIG. 13*d* shows at enlarged scale successive stages of the starting voltage for a leading edge dimmer. It is particularly to be noted that in general $\Delta t_{i-1}>\Delta t_i$ in order not to prolong unnecessarily the starting process.

Figure 14A:
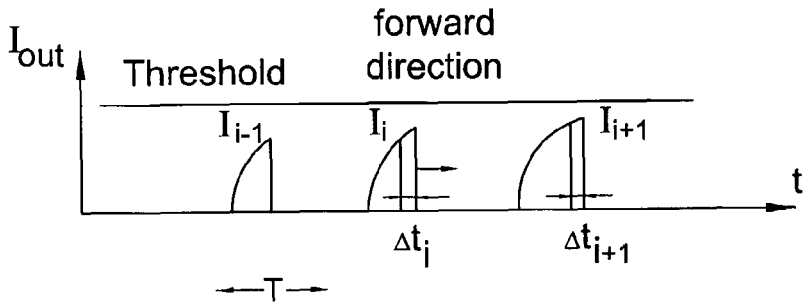
Figure 14B:
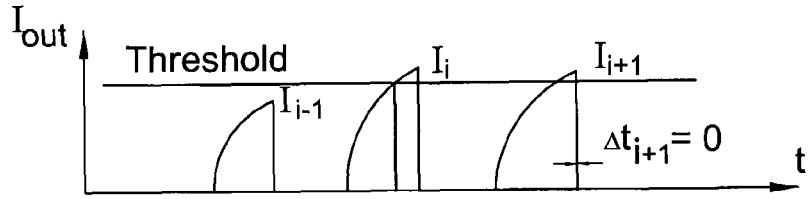
Figure 14C:
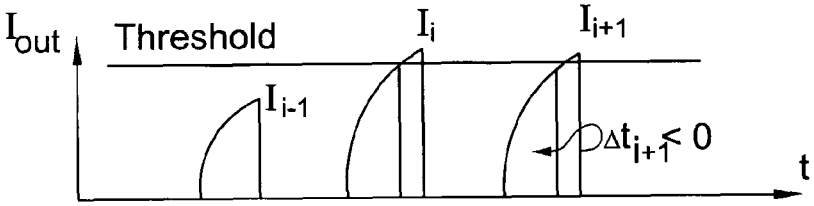

The reason for this will now be explained with reference to FIGS. 14*a* to 14*c* showing graphically partial current waveforms through the lamp filament. Toward the start of the AC half cycle as shown by $I_{i-1}$ the current magnitude is insufficiently large to cause the filament lamp to ignite, but it does cause the filament to start to heat. The increased temperature of the filament causes its resistance to increase and this, in turn, reduces the current flowing through the filament. Thus, there is a balance between increasing voltage which tends to increase the filament current and the decrease in the filament current caused by the increased resistance owing to self-heating. During the subsequent half cycle as shown by $I_i$ the current magnitude exceeds the lamp threshold current. Empirically, it might be thought that the current needs to be reduced by reducing the voltage during the next half cycle. However, this is in fact not required since the resulting increase in resistance owing to the increased $I^2R$ losses through the filament, reduces the filament current. Consequently, during the next half cycle, no reduction in voltage is required and the only compensation that is applied is that no change to the input voltage, and hence to the input current, is applied. This is shown graphically by the current waveform shown by $I_{i+1}$ where the time period of the voltage slice and hence of the current slice fed to the lamp filament remains as in the previous half cycle, i.e. $\Delta t_{i+1}=0$. This notwithstanding, it is seen that the filament current falls slightly owing to its increased resistance.

The programmable controller 87 shown in FIG. 8, which may be part of the ballast 121 shown in FIG. 11*d*, adjusts this balance so as to feed sufficient current through the lamp filament in sufficiently large increments that the filament heats gradually but nevertheless ignites within only several half cycles, thus reducing shock currents caused by too abrupt ignition.

Figure 1:
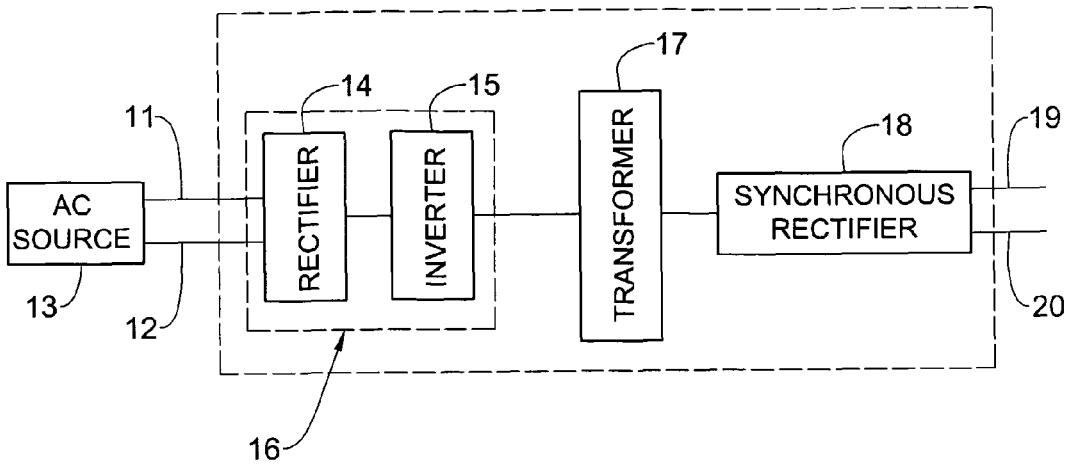
FIG. 1 (PRIOR ART)
FIG. 1 is a block diagram showing functionally a prior art low voltage illumination system.
Figure 2:
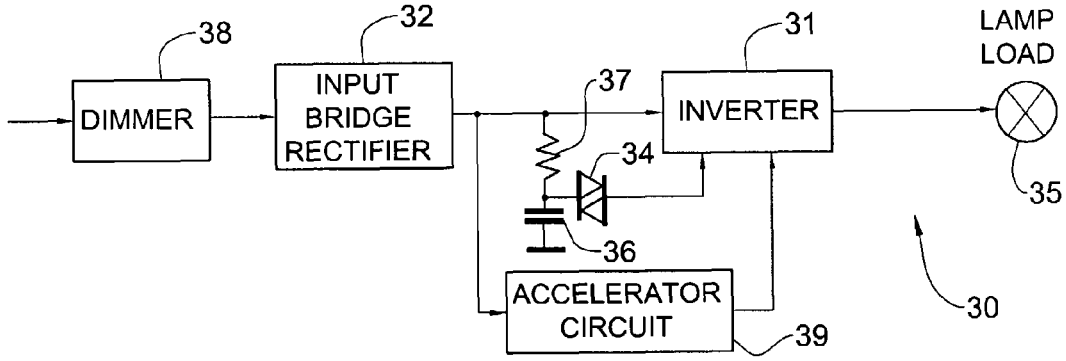
FIG. 2 (PRIOR ART)
FIG. 2 is a block diagram showing functionally a prior art igniter circuit for an inverter.
Figure 3:
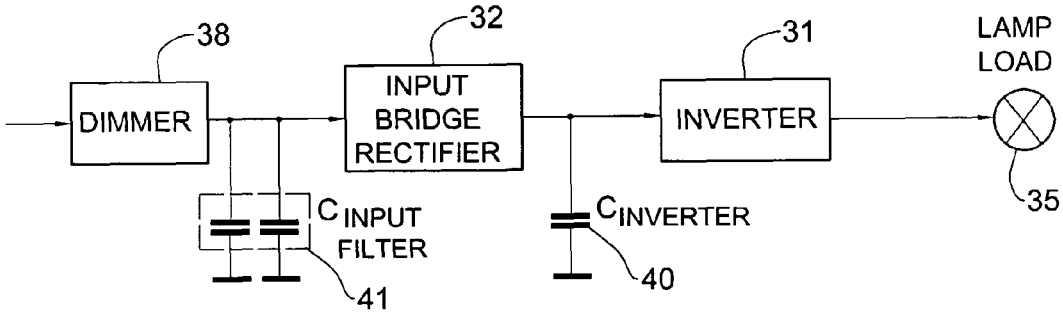
FIG. 3 (PRIOR ART)
FIG. 3 is a block diagram showing functionally a conventional topology of an inverter having capacitive input.
Figure 4A:
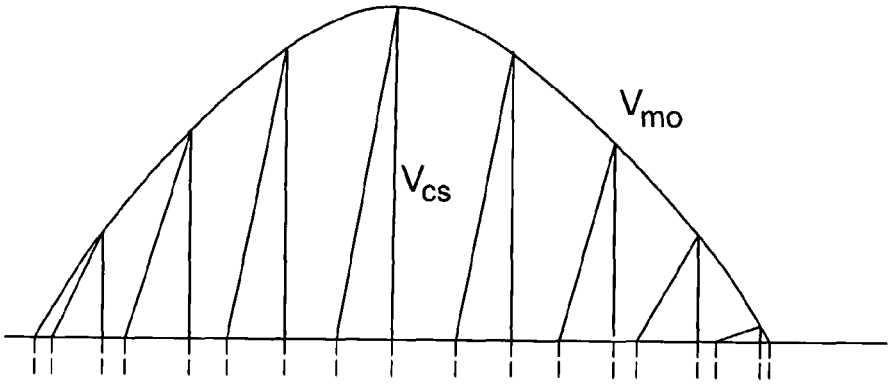
FIG. 4A (PRIOR ART)
FIGS. 4*a* and 4*b* show graphically voltage waveforms associated with a known soft start circuit designed to reduce shock currents caused by ignition of filament lamps.
Figure 4B:
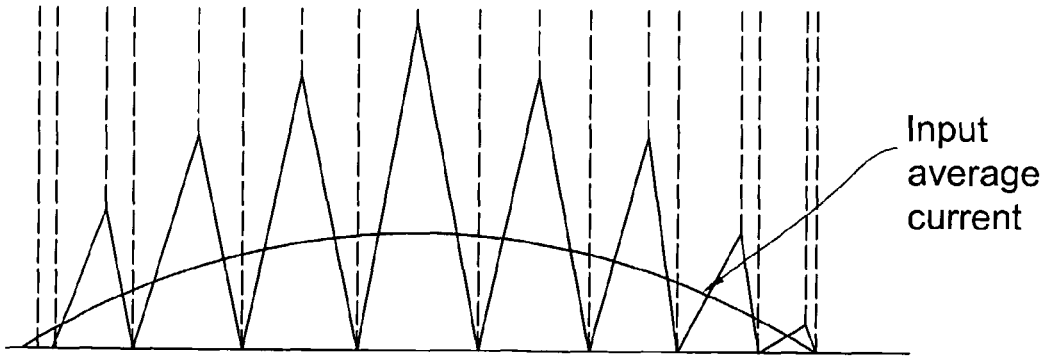
FIG. 4B (PRIOR ART)

This may be compared with the successive current spikes fed to the inverter of the prior art soft start circuit shown graphically in FIG. 4*b*. As noted above, although the average current through the lamp filament shown in FIG. 4*b* is reduced, each instantaneous current spike is of the same amplitude as the corresponding AC half cycle at the same instant of time. As against this, in the invention, the lamp filament current never exceeds a predetermined threshold set by the controller. Yet a further difference is that in the prior art circuit, successive soft start pulses are fed to the lamp filament in the same AC half cycle so that during the application of subsequent current pulses, current is already flowing through the filament. On the other hand, in the invention, during each successive half cycle the soft start current fed to the lamp filament always starts from zero.

It will be appreciated that modifications may be made to the preferred embodiments without departing from the scope invention as defined in the claims. For example, although not shown, the invention encompasses both half and full bridge inverters and both AC and nominal DC output voltage on the secondary.

The invention claimed is:

1. A method for reducing acoustic noise produced during use of a leading voltage edge dimmer so as to feed a controlled input voltage to an inverter coupled via bridge rectifier to the dimmer, the method comprising:

(a) determining a maximum jitter angle Δt of a leading edge of the dimmer; and (b) switching the inverter with a time delay larger than the maximum jitter angle Δt relative to a nominal firing angle t.

2. The method according to claim 1, further comprising:

(c) detecting that the dimmer does not fire and in response thereto:

i) applying a fraction of the input voltage to the inverter at time t; and ii) after a further time interval Δt applying the input voltage to the inverter.

3. A controller for feeding a controlled input voltage to an inverter coupled via bridge rectifier to a leading voltage edge dimmer, the controller being configured to:

(a) determine a maximum jitter angle Δt of a leading edge of the dimmer; and (b) switch the inverter with a time delay larger than the maximum jitter angle Δt relative to a nominal firing angle t.

4. A method for reducing acoustic noise produced during use a trailing voltage edge dimmer so as to feed an input voltage to an inverter coupled via bridge rectifier to the dimmer, the method comprising:

(a) determining a maximum jitter angle Δt of a leading edge of the dimmer; and (b) switching the inverter with a time advance larger than the maximum jitter angle AΔt relative to a nominal firing angle t.

5. The method according to claim 4, wherein the time advance is equal to the sum of a pre-correction time necessary for forming a smooth drop of the load current and the maximum jitter angle Δt of the trailing edge of the dimmer.

6. A controller for feeding a controlled input voltage to an inverter coupled via bridge rectifier to a trailing voltage edge dimmer, the controller being configured to:

(a) determine a maximum jitter angle Δt of a leading edge of the dimmer; and (b) switch the inverter with a time advance larger than the maximum jitter angle Δt relative to a nominal firing angle t.

7. A lamp dimmer including the controller according to claim 3.

* * * * *